US006388650B1

(12) United States Patent
Maltese

(10) Patent No.: US 6,388,650 B1
(45) **Date of Patent: *May 14, 2002**

(54) LOW VOLTAGE CONTROL METHOD FOR A FERROELECTRIC LIQUID CRYSTAL MATRIX DISPLAY PANEL

(75) Inventor: Paolo Maltese, Rome (IT)

(73) Assignee: Universita Degli Studi di Roma la Sapienza, Rome (IT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/269,308

(22) PCT Filed: Sep. 25, 1997

(86) PCT No.: PCT/IT97/00232

§ 371 Date: Jun. 1, 1999

§ 102(e) Date: Jun. 1, 1999

(87) PCT Pub. No.: WO98/13815

PCT Pub. Date: Apr. 2, 1998

(30) Foreign Application Priority Data

Sep. 27, 1996 (IT) ..... RM96A0661

(51) Int. Cl.[7] ..... G09G 3/36
(52) U.S. Cl. ..... 345/94; 345/96; 345/97
(58) Field of Search ..... 345/87–100; 349/100

(56) References Cited

U.S. PATENT DOCUMENTS 5,559,620 A * 9/1996 Tanaka et al. ..... 349/132
5,631,752 A * 5/1997 Tanaka ..... 349/173
5,818,411 A * 10/1998 Sakamoto et al. ..... 345/99

FOREIGN PATENT DOCUMENTS

EP 0661583 A2 * 7/1995
JP 08-054605 * 2/1996
WO WO95/06308 A 2/1995

OTHER PUBLICATIONS

Peter Pleshko, et al., "A Versatile Sleection System for Matrix Displays Requiring AC Drive Waveforms," *IEEE Journal of Solid–State Circuits*, vol. 10, No. 1, Feb. 1975, New York, U.S., pp. 60–64, XP002056180, cited in application, see pp. 60–64.

* cited by examiner

*Primary Examiner*—Steven Saras
*Assistant Examiner*—Amr Awad
(74) *Attorney, Agent, or Firm*—Smith, Gambrell & Russell, LLP

(57) ABSTRACT

When an ideal voltage reference is assumed such that the central value of the data voltage envelope is constant, the selection voltages include various successive portions which have a duration longer than a time control window, substantially correspond to a single polarity, have an average voltage in the range of 0.95 times $Vs^+$ to 0,95 times $Vs^-$, where $Vs^+$ and $Vs^-$ are the positive and negative peak values in the selection voltage assembly. Said assembly has overlapping selection times and is such that all positive voltages higher than 0.9 $Vs^+$ are included in a first time interval set and all negative voltages higher than 0.9 $Vs^-$ are included in a second time interval set, the voltages of said first set being interlaced with the voltages of said second set, with intervals of both sets within each time control window substantially corresponding to the two polarities of the selection voltage associated with the concerned window. Furthermore, the integrated circuits that generate the selection voltages are supplied with undulated voltages having peak-to-peak amplitudes higher than 0.1 ($Vs^+$–$Vs^-$), with maximum values in the first time intervals and minimum values in the second time intervals. In addition to the above outlined method, this invention relates to a display device comprising a ferroelectric liquid crystal matrix panel as well as a circuitry for generating and coupling the above described control voltages, also including selection voltage generating integrated circuits, that are supplied with voltages the difference of which is less than 0.9 ($Vs^+$–$Vs^-$).

23 Claims, 3 Drawing Sheets

LOW VOLTAGE CONTROL METHOD FOR A FERROELECTRIC LIQUID CRYSTAL MATRIX DISPLAY PANEL

This invention broadly relates to liquid crystal matrix panels and more particularly it concerns a control method for matrix panels of a direct addressing, ferroelectric liquid crystal (FLC) type with low voltages, so as to enable an apparatus comprising the display panel and the electronic control circuits to be produced at lower costs, without impairing its performances.

As it is known, the panels to which this invention relates are used in devices for displaying images and for optical computation applications, both of the projection and of the direct vision types. In these devices, each picture element (pixel) ideally corresponds to the intersection of an element of a first electrode assembly (for instance arranged as rows) and an element of a second electrode assembly (for instance arranged as columns) and materially it corresponds to an electro-optical cell comprising a ferroelectric liquid crystal in the room existing between two facing electrodes belonging to the above mentioned two electrode assemblies. In usual arrangements, a pair of crossed polarisers operatively completes the cell and makes visible the orientation changes of the director in the liquid crystal that can be of smectic C chiral type.

The panel consisting of FLC cells can be electrically controlled according to various addressing modes (or schemes) or modes for applying voltages and currents to the two electrode assemblies, so as to determine the states of all cells, the number of which is usually much higher than the number of electrodes. This invention relates to the broad case wherein the cells are addressed with voltage signals and the behaviour of the electro-optic cells depends on the differences between the voltages applied to two oppositely arranged electrodes. When we limit ourselves to examining the operation of the panel, it is apparent that voltage assemblies, to which the same voltage differences between the electrodes correspond, are quite equivalent and define the same addressing mode. The addition of a suitable time varying voltage to all voltages of an assembly enables any assembly equivalent thereto to be obtained. If, however, the panel drive circuits are considered, namely the circuits designed to generate the control voltages, only a few choices appear to be valid in implementation economy terms. As a matter of fact, the maximum voltage difference within the concerned integrated circuits is to be as much as possible decreased in fact it noticeably increases their costs and, in the best cases, such as it occurs with the usual choice of the CMOS technology for their implementation, it coincides with the minimum supply voltage difference therewithin. In the best cases, such maximum voltage difference, which we shall indicate hereinbelow as voltage dynamics of the integrated circuit, will be equal to the maximum difference between the voltages applied to the panel electrodes connected to the integrated circuit. According to the fastest addressing modes of the prior art, the maximum voltage differences between the panel electrodes appear between electrodes belonging to the same assembly, rather than between oppositely arranged electrodes. This invention furnishes teachings aimed at defining new addressing modes, having performances equivalent to the performances of any corresponding modes of the prior art, in which the voltage differences of the first type and consequently the voltage dynamics of the integrated circuits can be decreased with equal differences of the second type.

The main object of this invention is to teach new addressing modes with voltage signals having well defined characteristics which enable decreased maximum voltage differences to be established between two electrodes of the panel with respect to the prior art, with equal maximum voltages applied to the cells and broad achievable performances, as it is convenient in view of an inexpensive implementation of the drive circuits.

The device as a whole comprises the assembly of the described panel with the related electronic circuitry to generate the various voltage signals needed for its operation and with the interconnection elements to the panel electrodes. According to the expected application, in addition, polarisers, color filters, light sources and an optical system can be provided therein.

This invention additionally consists in the device comprising the above set forth assembly and operating according to the hereinafter described control method.

A description will follow in respect of the behaviour of the FLC cells as well as of the broad addressing issue of matrix display panels comprising said cells, which is more precisely subject-matter of this invention. This description will set forth suitably accommodated and synthesized knowledges and prior art teachings and it is believed necessary in order to explain the field in which the invention is intended to operate and its scope, as well as to introduce the terms that will be used to describe and to define it.

This invention relates to a matrix panel wherein the ferroelectric liquid crystal cells operate according to a bistable or multistable behaviour in absence of voltage or in presence of a continuously applied, high frequency voltage having a sufficient and suitable r.m.s. amplitude, known as high frequency or alternated current stabilization voltage. As it is known, such a role can be played by the control voltages used.

The ferroelectric liquid crystal can be of smectic C chiral type and the cells can be of the type in which the smectic layers are tilted with respect to a line normal to the cells, possibly broken up into differently tilted portions, with tilting angles smaller than the characteristic angle of the smectic C phase. Multi-stable behaviours can be related to microdomain mixtures of a number of stable states and be utilized for storage of intermediate shades. Reference is made, for instance to P. Maltese, "Advances and problems in the development of ferroelectric liquid crystal displays", in Molecular Crystals and Liquid Crystals, Gordon and Breach, vol. 215, pages 57 and followings and to the references cited therein.

By means of spaced apart rectangular pulses, of alternately opposite polarities, possibly when a high frequency stabilization voltage Vhf having a predetermined r.m.s. amplitude is present between such pulses, it is possible to obtain, as a result of each pulse, a cyclic transition of a cell from one extreme state to the other. For a given r.m.s. stabilization voltage, this effect occurs when such pulses have a duration which is higher than a sufficient value, that is a function of the voltage of the pulses themselves. Within a large range, the product of such sufficient durations times the corresponding pulse voltages is approximately constant and a bit greater than a minimum pulse area sufficient for the switching function Amin, within the voltage range of interest.

For a more accurate definition of Amin, in a range of high voltages near the maximum practically useable voltage, as well as of other parameters of the cells, not necessary in this specification, reference is made to the description of Italian Patent Application No. RM94A000102. For defining the characteristic voltage of the cells, describing their operation in the addressing stage and particularly explaining a mathematical model of their operation, reference is made to two articles of P. Maltese et al. in "Liquid Crystals", Vol. 15 (1993) pages 819 and following and in Digest of Technical Papers of 1993 Intl. SID Symposium, pages 642 and following, available by Society for Information Display, 1526 Brookhollow Drive, Suite 82, Santa Ana, Calif. 927055421, as well as in the references cited in said scientific papers.

A uniform cell is mainly characterized by Amin and by the dependence of Amin on Vhf. In view of the operation of the cell in the considered addressing mode, the significant values of Amin shall be determined in correspondence to a r.m.s. amplitude of Vhf equal to the one resulting from the voltages used in the addressing operation. As a matter of fact, such parameter values change from cell to cell of the panel, due to manufacturing tolerances (such as thickness differences) or to operation tolerances (such as temperature differences).

Many known addressing modes for FLC panels contemplate using voltage signals and different operations to realize the so-called refresh of the panel. By means of said signals, in well defined time intervals, it is possible to store all changes with respect to the previous image or to store a new image (write operation), after having erased the previous image (erasure operation). Between successive refreshes, it is possible to hold images stored on the panel, both when voltages are absent and when control voltages for other portions of the panel and any high frequency stabilization voltages are present. As a matter of fact, the refresh rates are suitable to display also moving images.

In many cases, the display refresh is carried out electrode by electrode of a first assembly, according to a scanning scheme wherein the writing operation is contemporaneously performed for all pixels belonging to a given electrode, for instance row by row. This very common case, namely a row-by-row scanning scheme, will be often referred to hereinafter, by way of exemplification and not by way of limitation, for the sake of concreteness and simplicity of explanation. It should be apparent, in fact, that the roles of the rows and of the columns can be exchanged and that the electrodes can be arranged according to a quite different geometrical pattern.

Many already known addressing methods, therefore, provide for refreshing the panel on the base of successive rows, in usually partially overlapping times, as determined by scanning or selection voltages applied to the row electrodes, independent of the images to be displayed. Said selection voltages corresponding to the refresh operation comprise pulses, namely even variable voltages, of substantially the same polarity in a finished time interval and having a single maximum value considered in absolute terms. As it is known from the above mentioned model and literature, the effect of the pulses on the cells, in an extended voltage range, substantially depends on the integral of the voltage with respect to time in relationship with Amin. The selection voltages, in correspondence to the refresh operations, can comprise, in the first place, one or more opposite erasure pulses, which effect the erasure operation of the previously stored image, thereby driving the cells of a row into a well defined state, independently from the concurrently applied column voltages. As it is known, in the case of two or more opposite erasure pulses, it is also possible and convenient to utilize the first of them to balance the d.c. component of the selection voltage. The erasure of a row can also be carried out contemporaneously to the erasure or write operations of other rows. The selection voltages additionally comprise one or more subsequent opposite pulses which carry out the write operation, namely they cause the cells of the concerned rows to be switched from an initial state into a final state, depending on the voltages applied to the columns, which, in turn, depend on the images to be displayed, within a single time window, designated as control window in the present specification, which can also consist of spaced apart subwindows, namely a number of not contiguous time intervals. As it is known, in absence of erasure, during a write operation, it is possible to control the state changes in one only direction and, in the refresh cycle, it is necessary to repeat the write operation with signals of opposite polarity in the selection voltages.

Among the above said subsequent pulses corresponding to a write operation, almost always in the prior art a last pulse exists to which a transition between extreme states can correspond, depending on the data voltages existing in the control windows. Such last pulse is designated in this specification as a write pulse. It can be divided into two portions separated by an interruption with voltages of opposite signs, as described in the prior Italian Patent Application No. RM94A000102 and in the article of P. Maltese et al. in "Journal of the Society for Information Display", Vol. 4 (1996), pages 75 and following. In the write operation, it can be preceded by opposite polarization pulses and can be followed by opposite stop pulses, as described in the scientific papers published by this inventor, to which direct or indirect reference has been made. Furthermore, it can be preceded by opposite compensation pulses aimed at compensating the Amin variations (due to any manufacturing differences and to temperature changes among the cells of the panel), as also described in Italian Patent Application RM93A000567 and in the paper by P. Maltese, on pages 371 and following of the proceedings of 13th International Display Research Conference (1993), available from Society for Information Display.

The minimum time offset between selection voltages that can be employed in respect of two different rows is designated as row addressing time and it determines the number of rows that can be addressed between two refresh operations. Usually, it is the same as the total width of the control window, thereby avoiding undesired content overlapping between successive control windows. Under the term "selection time", on the other hand, the time lapsing from the beginning of a first pulse and the end of the last pulse in the selection voltage, in respect of a selection operation is to be meant. It should be small in comparison to the time interval between two successive refresh operations, even if, on the other hand, it can be large with respect to the row addressing time and it will include the times corresponding to successive erasure and write operations.

At each refresh, therefore, the display control procedure provides for controlling the rows one by one in successive time windows. In one and same control time window as defined by a selection voltage, the latching is controlled, in all of the cells in the corresponding row, depending on the previous states and on the data voltages applied to the column electrodes in the time window, as functions of the image to be modified.

In any case, selection voltages are applied to the electrodes of a first assembly and each of these voltages is associated, at each refresh of the display, to a different control time window for all of the cells corresponding to the electrode of the first assembly (selected electrode). To the electrodes belonging to the second assembly data voltages are applied, each of which is formed by superposing the data voltage, applied within the different time windows associated to the selection voltages, for controlling all of the cells corresponding to the electrode belonging to the second assembly. Each pixel of the image to be displayed determines, in the case of a complete erasure of the previous image, the data voltage pertaining to the electrode of the second assembly, within the time window corresponding to the electrode of the first assembly. In a general case, said data voltage can also depend on the previous images on the same pixel as well as on correction factors connected to the preceding and following data voltages.

It is known that, to avoid undesired effects of state changes of cells not belonging to the addressed electrode, in each control time window, all data voltages should have the same average value independent from the state that the corresponding cell should take and such average value should be equal to the average value taken during the same time interval by each row voltage, so that no selection operation is currently being carried out. Such an average value is considered in this specification as an ideal reference value with respect to which each voltage is measured and it is assumed to be null. For the same reasons, furthermore, with respect to such reference value, each data voltage and each selection voltage should have a global average value null, independently from the present images.

All above described features are common both to the addressing method according to this invention and to the addressing methods of the prior art.

It is an object of this invention to provide an addressing method which enables, for voltages applied to electrodes of the same assembly and having values within two predefined, time invariable limits, typically corresponding to the supply voltages of the integrated circuits generating them, to overcome the limitations of the methods of the prior art and particularly to achieve shorter row addressing times and possibly an extended range of operation conditions.

As it can be easily ascertained, in many fast addressing methods described in the above cited references, the peak amplitudes of the selection voltages are higher than those of the data voltages. Furthermore, the time offset between the selection voltages corresponds to the minimum value, which is equal to the control windows and much lower than the selection time. As a consequence, time instants usually exist at which selection voltages having opposite peak levels appear on different tows. The maximum difference between two voltages applied to the electrodes of the panel at the same time instant turns out to be equal to the peak-to-peak voltage of the selection signals and higher than the maximum voltage applied to the cells.

It is a more particular object of this invention to provide addressing modes having the same speed performances, also based upon selection voltages higher than the data voltages and upon short control windows compared to the selection time, wherein the signals can be generated by integrated circuits having voltage dynamics lower than the peak-to-peak voltage of the selection signals.

Selection voltages noticeably higher that the data voltage occur also in the technologic field of the direct addressing, nematic liquid crystal matrix display panels. In this case, it is usual practice to substitute, for the addressing voltage assembly in which the voltage applied to not-selected rows is null, an equivalent voltage assembly, hereinbelow designated as compressed voltage assembly, which is obtained from the first assembly by subtracting therefrom a suitable time function voltage hereinbelow designated as compression voltage, in order to achieve lower peak-to-peak amplitudes of all selection voltages and consequently of the voltage dynamics of the related integrated circuits. In this respect, reference can be made to an article of H. Kawakami et al., in 1976 Biennial Display Research Conference Record, page 50, available from the above already quoted Society for Information Display and from IEEE, 445 Hoes Lane, P.O. Box 1331 Piscataway, N.J., 08855-1331 U.S.A., as well as to an article of P. Pleshko et al., in "IEEE Journal of Solid State Circuits", Vol. SC-10, pages 60 and following. The above mentioned voltage compression is possible because the selection times are coincident with the control windows and selection times relating to different rows do not overlap, as it occurs in the panels and with the addressing modes which this invention relates to.

As it appears from the above mentioned references, preliminary to this invention the matrix addressing problems of FLC cells have been closely investigated: as a result of these studies, the systematic exploitation of the time overlap of the selection signal has been introduced, various improved addressing schemes have been proposed and a simplified model of a ferroelectric liquid crystal cell has been proposed by which it is possible to forecast the operation of the cell in matrix addressing conditions.

This invention is based upon up-to-now not published and hereinbelow summarized observations, conclusions and studies. The above described choice of an ideal reference for voltages corresponding to a given addressing mode is not univocal. With respect to an ideal reference chosen as above described, multiple equivalent voltage assemblies exist for the same addressing mode. In fact, it is still possible to modify said reference by adding thereto a single voltage, variable as a function of the time and having a null average value in each control window. This voltage is subtracted from all selection and data voltages, while it maintains all differences unaltered as well as a null average value in all control windows. A suitable choice of the ideal reference is helpful in displaying the requirements of the integrated circuits supplied with constant voltages related to it. When it is desired to obtain an assembly of voltages biunivocally representing a mode, it is necessary that a further condition be fulfilled, in addition to forcing the data voltages in each control window to have a null average value. The Applicant is not aware that this problem has even been recognized in the past. Based upon our searches, it is not possible to extract from all representations shown in the cited or not cited publications the never previously published condition that, at each instant, the maximum possible absolute value of the data voltages be minimum. This amounts to assuming the central voltage of the envelope of all data voltages as a constant voltage with respect to the ideal reference, which voltage, instead, could vary as a function of the time in a practical implementation. As a basic representation of an addressing mode and as basic addressing voltages, we shall indicate the assembly of all voltages fulfilling said condition, since it biunivocally corresponds to an addressing mode. In the basic voltages, a null voltage often appears upon the not selected rows, but high frequency voltages can sometimes appear thereupon. For a continuous scan, both envelopes of selection and data voltages are periodical, with a period equal to the row address time. It can also be observed that it is easy to derive from the basic representation the voltage dynamics necessary for the column drive integrated circuits, as well as the supply voltages needed for them, usually equal to the peak-to-peak value of the so-identified data voltages. However, this offers scarce utility as long as the selection voltages are higher than the data voltages and, when supply voltages constant with respect to the reference are used, relatively high voltage dynamics are generated for the row drive integrated circuits.

It is possible to define a second representation, also biunivocally corresponding to a determined addressing mode, which coincides with the basic one for most of the modes of the prior art, even if it is in principle different. It is obtained by assuming that the central voltage of the envelope of all selection voltages is constant with respect to a new ideal reference, namely under a further condition for selecting the new ideal reference, similar to the above already mentioned one related to the row voltages. This new ideal reference level becomes then constant in time with respect to the minimum supply voltages of the row drive integrated circuits.

This invention is directly based upon the combination of two never published discoveries as hereinbelow disclosed. Whichever the selected reference is, when said minimum supply voltages are to be determined, it is necessary to consider the envelope of the row voltages and to study how it can be deformed by subtraction of a compression voltage. The central value of said envelope can be validly selected as the compression voltage. It has been discovered that, in the basic representation, the time non-overlapping of the selection times is a sufficient, but not necessary condition to arrive at compressed voltages. In fact, more extended conditions are identified under which it is possible to arrive at compressed voltages and under which the selection times of different rows can also be overlapping.

By referring to the basic representation and by considering the simple case in which the selection and data voltages have equal positive and negative peak values, when considered as absolute values, as indicated by Vd and Vs, respectively, and in which the selection voltages can be obtained from each other by a time translation, it can be found that:

each instant can correspond to only one control window associated with a particular selection voltage, which usually has the opposite peak levels within the window; for the compression voltage, we can select the same polarities as the selection voltage associated with the window; starting therefrom, we can define two time range assemblies corresponding to the two polarities of the compression voltage;

let us consider the more useful and simpler case in which the selected compression voltage has only two opposite levels +Vc and −Vc: at each time instant the selection voltages can reach an absolute maximum value Vs when they have the same polarity as the compression voltage and a value (Vs−2Vc) when they have opposite polarity; upon fulfilling these conditions, the selection times can be overlapping. It is not necessary, therefore, that the voltages be null outside the control window associated with each selection voltage.

A further question to be answered was whether it were possible, under such conditions, to design efficient waveforms for the selection voltages of the display which this invention relates to. As already described, the addressing modes of the above mentioned prior art provide for using, in the selection voltages, sequences of different opposite successive pulses within a selection time and sometimes high frequency polarization voltages outside of the selection time. It can be immediately observed that the latter voltages can exist at least up to peak amplitudes (Vs−2Vc).

As concerns the subsequent opposite pulses within the selection time, it has been observed that, in the modes according to the prior art, attempts have usually been made to obtain a short selection time, so as to reduce the time overlapping between multiple selection voltages. To this effect, for all pulses, the maximum voltage values capable to be generated by the row drive circuits have been employed, thereby achieving for them minimum durations, but making at once impossible to obtain compressed voltages. This problem is solved by our second discovery resulting from the experience as well as from the above mentioned FLC cell model. When it is desired to obtain a small control window and in respect of many or all pulses appearing in the selection voltage and particularly of voltages outside of the control window, it is not necessary that maximum voltages are applied or that they are continuously applied, but the same result can be achieved by reaching with lower average voltages and correspondingly longer times the same net values of the integral of the voltage with respect to time. A behaviour of the FLL cell is thereby obtained approximately equivalent for all addressing purposes. In particular, for a single pulse, a succession or a train of shorter pulses can be substituted, having the same sign and similar amplitude, separated by voltages having a smaller absolute value. The total duration of said succession will be greater than the sum of the durations of the new pulses and this will be comparable to the duration of the substituted pulse. Such substitutions are possible in view of the fact that, as it will be hereinbelow explained, they make it possible to achieve compressed voltages, even if a greater number of selection voltages are overlapping in time.

The method which is subject-matter of this invention provides for using an assembly of selection voltages, as above well specified, in combination with using row drive integrated circuits, supplied as above well specified. In the basic representation obtained under the assumption of an ideal voltage reference, in which the central value of the data voltage envelope is constant, the assembly of the selection voltages comprises selection voltages with not-overlapping control windows and overlapping selection times. Said assembly includes all positive voltages higher than 0.9 times the value of the positive peaks in a first set of time intervals and all negative voltages with an absolute value higher than 0.9 times the value of the negative peaks in a second set of time intervals. The intervals of the second set are inserted between the intervals of the first set, but do not overlap thereupon and, within each control time window, intervals are included that belong to both sets, substantially corresponding to the polarities of the associated selection voltage. Each selection voltage comprises successive portions having durations longer than the control window, substantially corresponding to a single polarity, with an average voltage value lower than 0.95 times the corresponding peak voltage. The integrated circuits generating the selection voltages are supplied with voltages that, with respect to the above mentioned ideal reference, include undulations, with maximum values in the first set of time intervals and minimum values in the second set, with a peak-to-peak amplitude greater than 0.1 times the difference between the positive peak values and the negative peak values in the assembly of the selection voltages. Subject-matter of this invention is also a display device comprising a ferroelectric liquid crystal matrix panel and circuits for generating and coupling said above described control voltages, including integrated circuits for generating the selection voltages supplied with voltages whose difference is less than 0.9 ($Vs^{+}-Vs^{-}$).

If the first intervals or the second intervals are separately considered, selection voltages having peak-to-peak values less than the global one are observed together with central values of the voltages belonging to the first intervals higher than the central values of the voltages belonging to the second intervals. Thus, the second representation of the addressing mode according to this invention is different with respect to the basic one and results into an envelope of the row voltages having a peak-to-peak amplitude lower than that of the basic representation, in other words it results into compressed voltages as above described. Thanks to the choice of these references, lower voltage dynamics and consequently lower supply voltages for the row drive integrated circuits are possible.

It is to be understood that, in the method according to this invention, in comparison to a practical voltage reference constant with respect to one of the supply voltages of said row drive integrated circuits, the central value of the data voltage envelope, as utilized in the basic representation of the voltages as ideal reference, will include undulations. When also the column drive integrated circuits are supplied with constant voltages with respect to the same practical reference, increased voltage dynamics will result for them.

It is possible to obtain minimum voltage dynamics both for the row integrated circuits and for the column ones, as evidenced in the above cited article of P. Pleshko et al., by physically generating two versions of a compression voltage translated to different levels and by using them to supply the row drive integrated circuits. This can be achieved by means of simple circuit techniques well known in the electronic field, for instance by means of circuits for coupling to two different supplies. As alternative approach, the column drive integrated circuits can be supplied between two level translated versions of the opposite value of a compression voltage. The main drawback of this technique is the fact that transformer or optical insulators are necessary to transfer the signals needed by the integrated circuits not supplied with voltages constant with respect to the ground reference of the circuits.

In another approach of practical interest, as initially proposed in the above mentioned article of H. Hawakami et al. for nematic liquid crystal displays and as subsequently adopted as general practice in the industrial field, the two dynamics are made equal. To this purpose, in the above explained simple case, a compression voltage consisting of a square waveform with amplitude $Vc=(Vs+Vd)/2$ is needed. In this manner, the possibility is given to supply both the row and the column drive circuits from the same supply voltages. As it can be made in connection with commercially available integrated circuits, it will be possible to use, for controlling the nematic liquid crystal displays, in addition to the supply voltages, two voltages of intermediate levels as the row drive voltages and other two voltages of intermediate levels as the column drive voltages, all voltages being obtained by means of a voltage divider.

In the method according to this invention, it is possible to use various approaches in respect of the waveforms of the selection voltages and of the data voltages. All information known and broadly described in connection with the opposite pulses provided by the prior art can be applied to the subsequent portions, having a duration longer than the control window, substantially corresponding to a single polarity, as appearing in the selection voltages according to this invention.

The method according to this invention also comprehends variations corresponding to an addressing mode of the prior art, in which, to each of said subsequent portions of the selection voltages having a duration longer than the control window and substantially having a single polarity a single pulse according to the prior art corresponds, said pulse having an average voltage higher than the voltage of said portion, a decreased total duration and substantially equal value of the integral of the voltage with respect to time.

In some variations of the method according to this invention, which are preferred variations in the case of voltages lower than the characteristic voltage of the cell, as defined in the above mentioned model, said subsequent portions of the selection voltages comprise trains of multiple pulses of the same polarity, each having a duration not longer than the control window, separated by voltages having an amplitude the absolute value of which is 0.9 times the peak voltage of the same polarity in the assembly of the selection voltages.

In some variations of the method according to this invention, which are preferred variations in the case of voltages higher than the characteristic voltage of the cell, said subsequent portions of the selection voltages are substantially rectangular pulses. Their voltage is lower or equal, in absolute value, to 0.9 times the peak voltage of the same sign in the assembly of the selection voltages and it is preferably equal to the peak voltage of the same sign among the data voltages.

For the above reasons, it turns out to be advantageous to use successive portions of the selection voltages corresponding to balance, erasure, possible pause, compensation, write and possible stop functions. It should be admitted, however, that, in each of the above mentioned successive portions of the selection voltage, having a duration longer than the control window, substantially corresponding to a single polarity, pulses or pauses can be inserted also at the extremities, such pulses or pauses having values of the corresponding integrals of the voltage with respect to time lower than 0.2 Amin, without substantially modifying the waveform of the selection voltage, as far as the behaviour of the FLC cells is concerned. In view of this, the description of the succession of the portions and particularly of the manner in which they are to be counted ignores the possible presence in the selection voltage of pulses or pauses having values of the corresponding integrals of the voltage with respect to time lower than 0.2 Amin.

Preferably, said successive portions of the selection voltage comprise a possible first initial portion, sized so as to result both into an initial erasure of the cell state prior to the row selection and into a null average value of the selection voltage during the selection time, with an absolute value of the integral of the voltage with respect to time lower than 3 Amin, and a second initial portion, sized so as to result into a complete erasure of each cell, with an absolute value of the integral of the voltage with respect to time in the range between Amin and 5 Amin.

After the above mentioned initial portions, possibly complemented with further erasure portions and before the next portion, that can be aimed at compensating the variations in Amin or, in absence thereof, at writing, the selection voltage can advantageously include a pause, even having a variable duration, provided that such duration is sufficiently long, preferably in the range between two times the duration of the control time window and one half the minimum time interval between two refresh operations.

It is possible to insert before the write pulse, compensation portions for compensating the variations of Amin occurring as a consequence of the construction disuniformities and of the temperature variations, by suitably adapting to the solution of this problem the teachings of the above mentioned patent application RM93A000967 and of the article of P. Maltese in the proceedings of 13th International Display Research Conference. Preferably, such portions have an absolute value of the integral of the voltage with respect to time in the range 0.8 Amin to 3 Amin.

The cell state reached at the end of the control window is often unbalanced so as to lean toward one of the two states, even if it strongly depends on the data voltage in the window. Any successive portions occurring in the selection voltage force the cell, at their end, to an intermediate switching condition on one side or on the other side of the switch non-return point, according to the state of the cell at the end of the control window, without the possibility for the data voltage contemporaneously present to substantially modify the state reached at their ends.

In the control window, in order to obtain extreme control effects, balanced selection and data voltages are used both having maximum amplitude, with polarity changes in time correspondence and with a ratio between the peak amplitudes in the range 20:1 to 1:1.

Preferably, the data voltages will be substantially compensated for intermodulation purposes. Under this terminology, it is intended to refer to data voltages such that the integral of the voltage with respect to time, from the begin of the corresponding control time window to a generic instant therewithin, is a function of the time and the average value of this function within the control window is lower than one tenth the peak value (that is substantially null).

According to the indications furnished by the above mentioned model, when voltages higher than the characteristic voltage of the cell are involved, outside of the control window, aiming at decreasing the undesired effects of the data, the level variations of the selection voltage preferably will be substantially centered around instants that delimitate immediately preceding and subsequent segments of the data voltages having a null average value. Thus, in time coincidence with segments of the data voltages having a null average value, selection voltages having constant values in the time will be preferably used. Preferably, said segments will null average value will be whole data voltages and will be substantially compensated for intermodulation purposes.

In suitably designed cells, it will be possible to obtain intermediate levels, by using for the data voltages a scale of variations corresponding to a scale of different correlation levels with the selection voltage in the control window.

It will also be possible, for instance, for obtaining a better optical contrast, to provide for high frequency stabilization of the cells. To this effect, in addition to said successive portions, also a high frequency voltage can be included into the selection voltages, outside of the selection time and within the possible pauses. In such intervals, it will have preferably a substantially constant r.m.s. value. More precisely, the r.m.s. amplitude of the differences between the data voltages and any voltages occurring in such intervals in the selection voltages can be substantially constant.

The efficiency of the above described control method has been evidenced both in experimental tests and in numeric simulations according to the quoted model, in chevron cells including liquid crystals with spontaneous polarizations between 2 and 100 $nC/cm^2$.

Further details and advantages of this invention will be apparent from the following description by referring to the enclosed drawings wherein three preferred embodiments are shown by way of illustration and not by way of limitation.

In all drawings, the voltages used are shown by means of their respective diagrams as a function of the time. It has been believed useless to also show the matrix panel, the structure of the drive circuits and the optical transmission of the voltages used therein, because it has been considered sufficient to describe the apparatus according to this invention, including the drive circuits, in which the matrix panel is assembled, as well as the operation according to the invention of the panel used therein and of other panels that could be different with respect to it as to construction details.

In the drawings, in which, except for FIGS. 6 and 7, the basic representation of the addressing mode has been utilized, FIG. 1 shows two consecutive selection voltages according to a first example;

Figure 1:
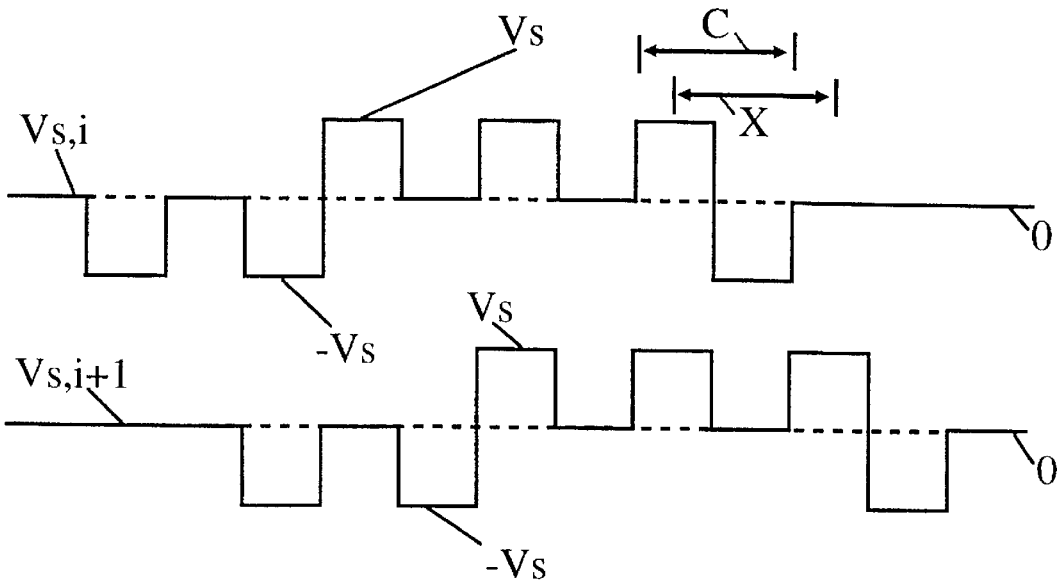

As concerns the first example, FIG. 1 shows, in correspondence to a refresh operation, in the basic representation, a first selection voltage $V_{s,i}$ and, in time correspondence, two variations C and X of the control window corresponding thereto and the immediately subsequent selection voltage $V_{s,i+1}$, equal to the first one but having a delay equal to the duration of the window C or X. Both voltages have a rest value O, peak values Vs and −Vs equal to the values of the complete assembly and include pulse trains in stead of single pulses as in the prior art. The first two-pulse train and the second three-pulse train perform the erasure of the cells by balancing the d.c. component of the last pulse, corresponding to the write operation of the cells. It is easily observed that, even if they are not illustrated in the Figures, two sets of time intervals, different for the whole assembly of the selection voltages, are dedicated to the positive pulses and to the negative pulses.

Figure 2:
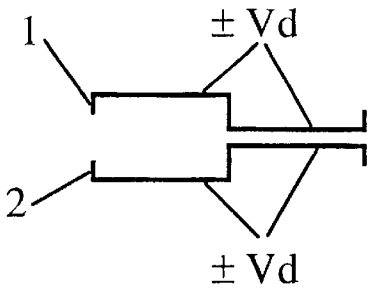
FIG. 2 shows a first variation of the data voltages of the first example.

FIG. 2 shows, in a single time scale expanded with respect to the one of FIG. 1, the data voltages 1 and 2 of a first variation of the first example, having positive and negative peak values ±Vd, utilized in controlling each cell of the matrix in order to obtain the two final opposite states. Their presence on a column electrode, in time correspondence to the control window C of voltage $V_{s,i}$ of FIG. 1, as applied to the i-th row, determines the state of the cell at their cross point. In the case of a display panel without intermediate grades, the whole data voltage upon a column comprises a segment sequence as shown.

Figure 3:
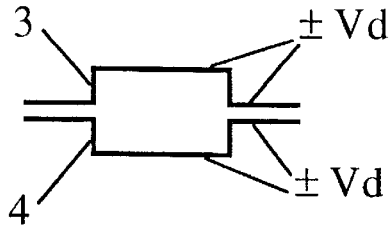
FIG. 3 shows a second variation of the data voltages of the first example, as used also in a second and a third example.

FIG. 3 shows the data voltages 3 and 4 of a second variation of the first example, in completely like manner, as well as of the second and third examples. They appear to be compensated for intermodulation purposes and are utilized in time correspondence to the control window X of voltage $V_{s,i}$ of FIG. 1, for the first example, and in time correspondence to the control window X' of FIG. 5 for the second example and X" of FIG. 6 for the third example.

Figure 4:
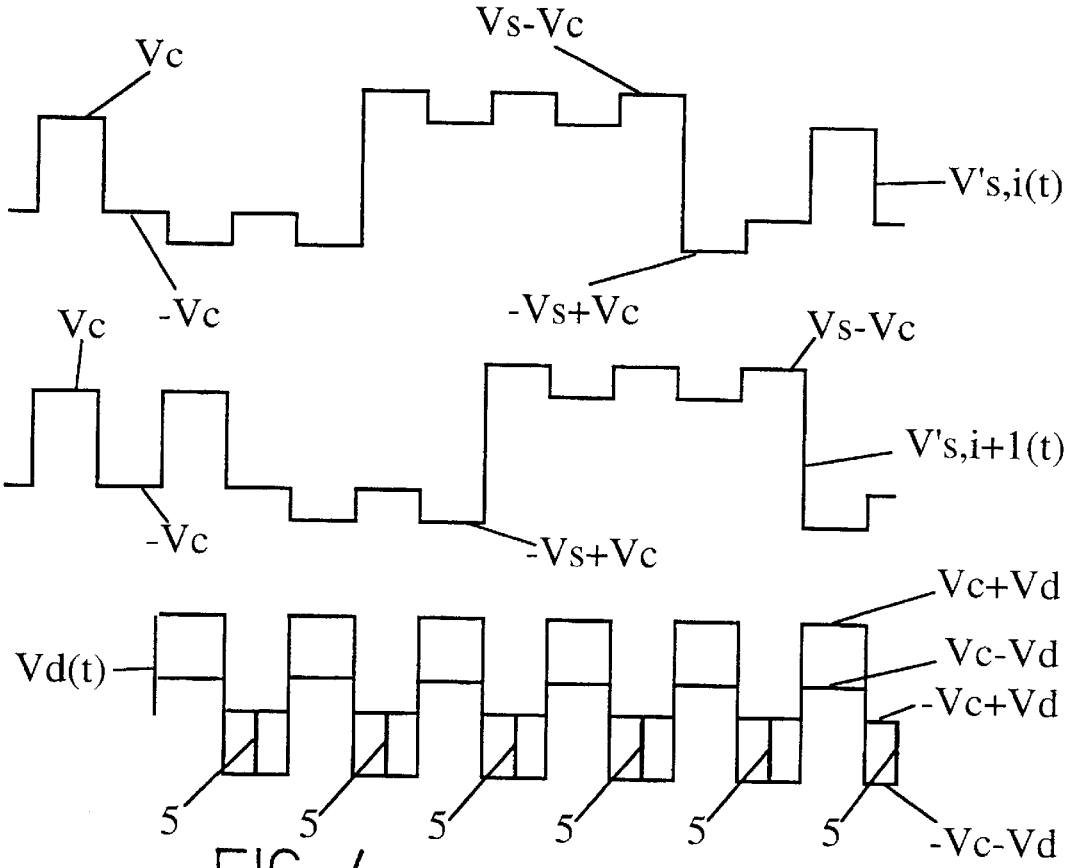
FIG. 4 shows, in time correspondence to one another, the compressed versions of the selection voltages of FIG. 1 and the envelope of the corresponding data voltages.

FIG. 4 shows, in time correspondence to one another, the compressed selection voltages $V'_{s,i}$ (t) and $V'_{s,i+1}$ (t) obtained by subtracting, from those of FIG. 1, a square wave (not shown) having a peak amplitude Vc, which appears to be inverted where a voltage O was present in FIG. 1, while the positive peak voltage has been reduced to Vs−Vc and the negative one has been brought to −Vs+Vc. FIG. 4 shows additionally, also in time correspondence, the envelope of the corresponding data voltage Vd(t), that has the following four voltage levels Vc+Vd, Vc−Vd, −Vc+Vd and −Vc−Vd, as obtained from the data voltages of FIGS. 2 or 3, by subtraction of said square wave. The level transitions 5 are present only in the case of the data voltages of FIG. 3 in the basic representation. It is apparent that all voltages can be equally translated to all positive levels or to all negative levels with respect to the ground level of the circuits. In a preferred embodiment, the amplitudes Vc+Vd and Vs−Vc are made equal and the voltage dynamics required by all circuits are Vs+Vd.

Figure 5:
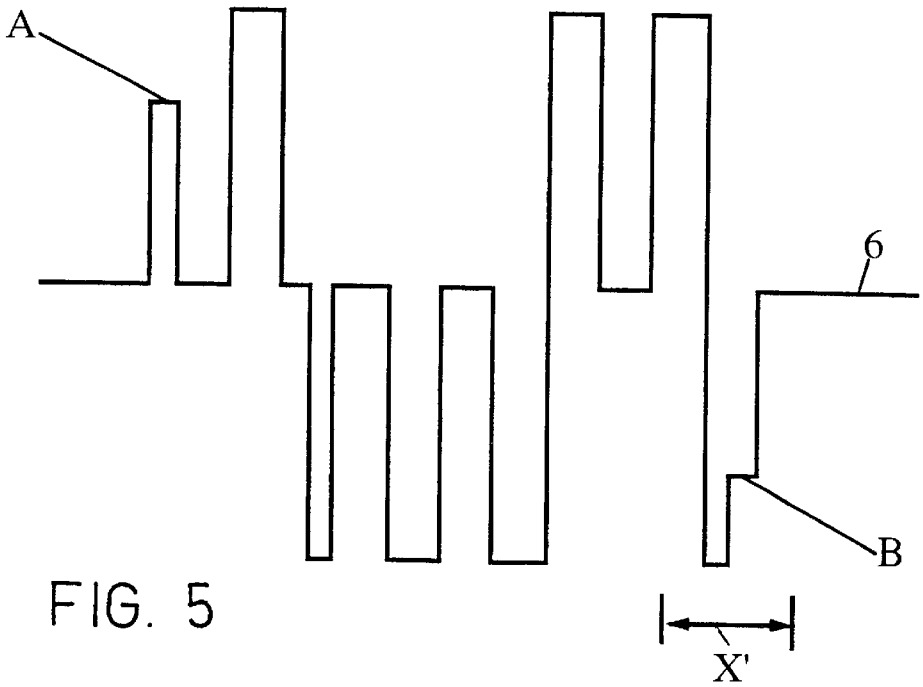
FIG. 5 shows the selection voltage utilized in the second example.

FIG. 5 shows the selection voltage 6 compensated in respect of the variations of Amin, as utilized in the second example. The first two pulse trains of this voltage have balancing and erasure purposes, the third pulse train is substituted for the compensation pulse provided in the prior art and the last pulse train performs the write operation, according to the data voltage applied during the control window X'. The intermediate levels A and B have the same absolute value and can be simultaneously adjusted so as to obtain the largest operation ranges of the panel. The row address times obtained are just a bit longer than those of the first example, with a resulting advantage consisting in a larger extension of the operation conditions.

The operation according to the illustrated examples has been evidenced in matrix panels in which use has been made of liquid crystal ZLI4851-025, having spontaneous polarization of 8.5 nanoCoulomb/cm$^2$ at 25° C., supplied by Merck at Darmstadt (Germany), comprising chevron cells, wherein a layer of 1.5 micrometer thickness of the liquid crystal is oriented due to the contact with the surfaces of a polymer rubbed according to the known prior art, thereby forming stable cells, the operation of which has been observed at about 25° C., and obtaining row addressing times of about 230 microseconds for total voltage dynamics of only 8.8 Volts. In the second example, larger operation ranges have been obtained, corresponding to acceptable address times for a cell with a ratio higher than 2:1.

The address modes of first and of the second examples belong to the low voltage mode class, as defined in the above quoted articles of P. Maltese et al., and they correctly operate when even very low voltages with respect to the characteristic one are applied to the cells. The method according to this invention has been found useful also for high voltage modes, as defined in the same literature.

Figure 6:
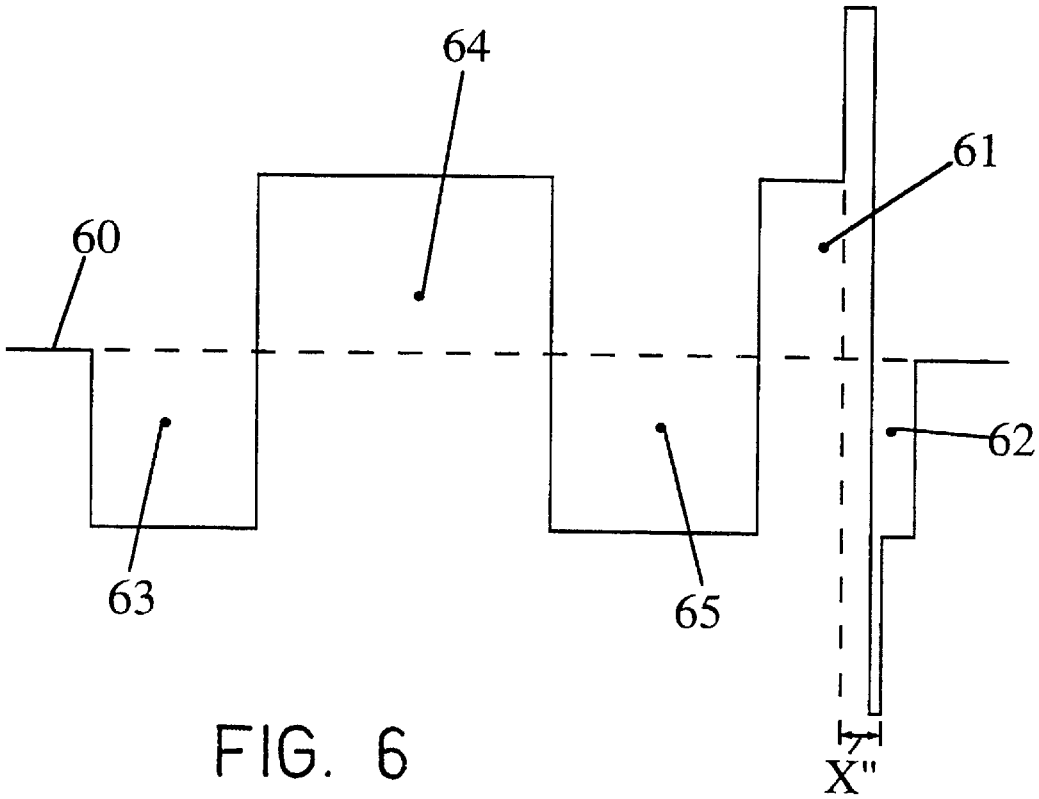
FIG. 6 shows the selection voltage utilized in the third example.

FIG. 6 shows the selection voltage 60 utilized in the third example, relating to a high voltage mode with Amin compensation, that can be obtained by modifying according to this invention the first example illustrated in co-pending Italian Patent Application No. RM93A000567, in which voltages having approximately one half the maximum values were also utilized before the control window, but not after it. In particular, completely analogous effects and performances have been obtained by substituting, for the last maximum voltage stop pulse according to the prior art, a shaped and longer stop pulse 62, of the same surface area, the voltage of which is one half outside of the control window X". The same half level is adopted for balancement and erasure pulses 63 and 64, for compensation pulse 65 and for shaped and write pulses 61, as well as for the data voltage, not shown.

Figure 7:
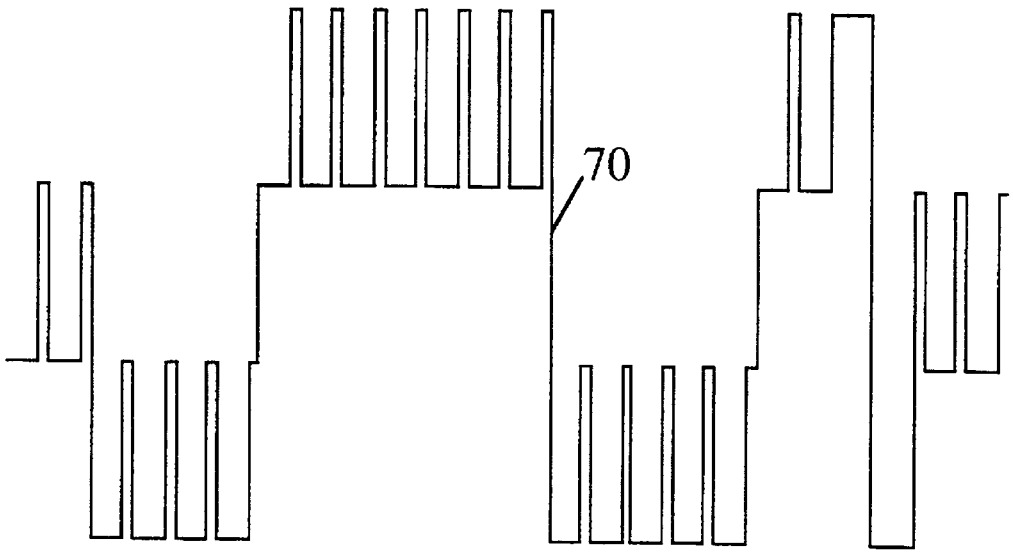
FIG. 7 shows the compressed versions of the selection voltages of FIG. 6.

FIG. 7 shows the version 70 of the selection voltages of FIG. 6, obtained by subtracting therefrom the compression voltage, not shown, obtained by periodically repeating the selection voltage in window X" reduced to one fourth amplitude. The resulting dynamics for the compressed selection voltages are three fourths the one of FIG. 6. The corresponding data voltages, the peak-to-peak amplitude of which is increased by the same amount, thereby becoming equal to the amplitude of the selection voltages, are not shown. The same supplies can now be utilized for all row and column drive integrated circuits. The obtained results are very similar to the already published ones. For the same row address time of 16 microseconds, the dynamics of the selection voltages are reduced from ±48 V to ±36 V.

According to the invention, greater compressions for the selection voltages could be achieved by further extending all pulses and by reducing the voltages thereof to less than half the maximum value and than the data voltages, excluding the voltages in the control window. This, however, would result into increased dynamics of the data voltages which would become higher than those of the selection voltages. A preferred embodiment will adopt, for said reduced voltage, a value equal to the data voltages.

The preferred embodiments of this invention have been described hereinbefore, but it should be expressly understood that those skilled in the art can make other variations and changes, without so departing from the scope thereof.

What is claimed is:

1. A method for controlling a matrix display panel in which each picture element (pixel) ideally corresponds to an intersection of an element of a first electrode assembly and an element of a second electrode assembly and to an electro-optical, multistable cell comprising a ferroelectric liquid crystal existing between two facing electrodes belonging to said two electrode assemblies, said multistable cell having as a characteristic parameter, a minimum product time x voltage, Amin, within a voltage range of interest, when spaced apart rectangular pulses having alternately opposite polarities are applied, adapted to switch said cell from an extreme state to another state, when between pulses a voltage of constant r.m.s. amplitude Vhf is applied, in which method selection voltages are applied to electrodes of said first assembly and each of these voltages is associated, at each selection operation of said panel, to a control time window not overlapping to other control time windows for all cells corresponding to said electrode of said first assembly, while data voltages are applied to electrodes belonging to said second electrode assembly and each of these data voltages is formed by superposing a data voltage for each pixel, namely voltages applied within different time windows associated with selection voltages and designed to control each of said cells corresponding to said electrode belonging to said second electrode assembly, said voltages depending on each value describing a pixel of an image to be displayed in correspondence to said electrode of said second assembly, wherein in a basic representation obtained by assuming, as a voltage ideal reference, a one for which a central value of an envelope of data voltages is constant and each data voltage has a null average value, independently from a position of a corresponding pixel and from a value describing it, said average value of each selection voltage, calculated both globally and within each control window associated with other selection windows and not overlapping with selection time, namely a time between a first pulse and an end of a last pulse relating to a selection operation, in said selection voltage, is substantially null, characterized in that selection voltages include various successive portions which have a duration longer than a time control window, substantially corresponding to a single polarity and having an average voltage in a range of 0.95 times $Vs^+$ to 0.95 times $Vs^-$, where $Vs^+$ and $Vs^-$ are positive and negative peak values in said selection voltage assembly and said selection voltage assembly has overlapping selection times and is such that all positive voltages higher than 0.9 times said positive peak values $Vs^+$ are included in a first time interval set and all negative voltages higher in absolute value than 0.9 times said negative peak values $Vs^-$ are included in a second time interval set, time intervals of said second set being interlaced without overlaps with time intervals voltages of said first set, with intervals of both sets within each time control window substantially corresponding to two polarities of said selection voltage associated with a concerned window; and in that the integrated circuits that generate said selection voltages are supplied with undulated voltages which, with respect to an ideal reference, have maximum values in time intervals of said first set and minimum values in time intervals of said second set and have peak-to-peak amplitudes higher than 0.1 times the difference between said values of said positive peaks $Vs^+$ and of said negative peaks $Vs^-$.

2. A method according to claim 1, characterized in that, with respect to a voltage reference which is constant with respect to a power supply of an integrated circuit that generates selection voltages, a central value of an envelope of the data voltages includes undulations.

3. A method according to claim 1, characterized in that voltage dynamics of integrated circuits that generate the selection voltages are reduced with respect to a maximum swing of the selection voltages.

4. A variation of the method according to claim 1, characterized in that each of said successive portions of the selection voltages, having a duration longer than said control window, and substantially corresponding to a single polarity, corresponds to one of opposite successive pulses, each said pulse having an average voltage higher than the voltage of said portion, a lower total duration and a substantially equal value of an integral of the voltage with respect to time.

5. A method according to claim 1, characterized in that said successive portions of the selection voltage comprise trains of pulses of the same polarity, each having a duration not longer than the control window, separated from one another by voltages both having maximum amplitudes, with polarity changes in time correspondence and with a ratio between the peak amplitudes in the range 20:1 to 1:1.

6. A method according to claim 1; characterized in that said successive portions of the selection voltage are substantially rectangular voltage pulses having an absolute value lower than or equal to 0.9 times the peak voltage of the same sign in the assembly of the selection voltages.

7. A method according to claim 6 characterized in that said rectangular pulses have a voltage value equal to the peak voltage of the same sign of the data voltage.

8. A method according to claim 1; characterized in that said successive portions of the selection voltage comprise an intial portion such that the integral of the voltage with respect to time has an absolute value in the range of Amin to 5 Amin.

9. A method according to claim 8, characterized in that said initial portion is a second portion after a first initial portion of opposite polarity and said second portion has a voltage the integral of which with respect to time is lower than 3 Amin and characterized in that the average value of the selection voltage during the selection time is null.

10. A method according to claim 9, characterized in that, after said initial portions and before said control window, said selection voltages include a pause and said pause can have a variable duration, provided that said duration is in a range from twice a duration of the control time window and one half a minimum time between two refresh operations.

11. A method according to claim 10, characterized in that, after said initial portions and before the control window, the selection voltages include an intermediate portion, in which the integral of the voltage with respect to time has an absolute value in the range 0.8 Amin to 3 Amin.

12. A method according to claim 1, characterized in that the selection voltages also include further portions, pulses or pauses.

13. A method according to claim 1, characterized in that the control windows also include, in correspondence to extreme control effects, balanced selection voltages and data voltages, for generating the selection voltages which are supplied by voltages the difference of which is less than 0.9 (Vs+−Vs−).

14. A method according to claim 1, characterized by data voltages such that the integral of the voltage with respect to time, computed from a beginning of a corresponding control time window to a generic time instant, is a time function with an average value within the control window that is lower than one tenth a peak value.

15. A method according to claim 1, characterized in that, in each selection voltage, changes of level exist that are not contained in the control window and are substantially centered around time instants delimiting immediately preceding and subsequent portions of the data voltages, the average value of which is null.

16. A method according to claim 1, characterized in that, in each selection voltage, voltage levels exist that are substantially constant during portions of the data voltages having a null average value.

17. A method according to claim 1, characterized in that scaled voltage variations are employed as data voltages, corresponding to scaled different correlation levels with the selection voltage within the control window.

18. A method according to claim 1, characterized in that, in addition to said successive portions, a high frequency voltage is present in the selection voltages, outside of the selection time and within the possible pauses.

19. A method according to claim 1, characterized in that differences between the data voltages and present selection voltages, outside of the selection time and/or the pauses included therein, have a substantially constant r.m.s. value.

20. A method according to claim 1, characterized by a high frequency stabilization of the cells.

21. A display device comprising a ferroelectric liquid crystal matrix panel and circuits for generating and applying control voltages according to claim 1, characterized by using integrated circuits.

22. A method according to claim 21, characterized in that said ferroelectric liquid crystal is of chiral C smectic type.

23. A method according to claim 21, characterized in that said ferroelectric liquid crystal has a spontaneous polarization in the range 2 to 100 $nC/cm^2$.

* * * * *